US005685590A

United States Patent [19]

Sharrow

[11] Patent Number: 5,685,590

[45] Date of Patent: Nov. 11, 1997

[54] CARRIAGE FOR SELECTIVELY AND REMOTE POSITIVELY SUSPENDINGLY ENGAGING AND DISENGAGING A LOAD IN TRANSPORTING SAME FROM ONE LOCATION TO ANOTHER

[75] Inventor: Joseph E. Sharrow, King George, Va.

[73] Assignee: The United States of America as represented by the Secretary of the Navy, Washington, D.C.

[21] Appl. No.: 586,941

[22] Filed: Jan. 3, 1996

[51] Int. Cl.[6] ..... B66C 1/66

[52] U.S. Cl. ..... 294/68.3; 294/67.1

[58] Field of Search ..... 294/67.1, 67.3, 294/67.31, 68.3, 81.1, 81.5, 81.51, 81.56, 82.24, 82.26, 82.27, 82.31, 82.32, 86.4

[56] References Cited

U.S. PATENT DOCUMENTS

| | | | |
|---|---|---|---|
| 2,047,141 | 7/1936 | Fildes | 294/68.3 |
| 2,986,421 | 5/1961 | Grove | 294/82.31 X |
| 3,056,623 | 10/1962 | Herbert | 294/82.26 |
| 4,372,597 | 2/1983 | Stillman et al. | 294/81.51 X |
| 4,728,136 | 3/1988 | Newhouse et al. | 294/68.3 |
| 5,335,881 | 8/1994 | Zaguli | 294/86.4 X |

*Primary Examiner*—Johnny D. Cherry
*Attorney, Agent, or Firm*—Elmer Goshorn

[57] ABSTRACT

Improved carriage for selectively engaging and disengaging a load for transporting same from one location to another such that the carriage upon full engagement with the load is positively coupled thereto for effecting its transport with minimal risk. To this end, the carriage is advantageously made up of a pair of guide blocks, a pair of actuating rods and a biased pivotally mounted pawl. Each actuating rod is biasingly mounted in its associated guide block. All of the aforementioned elements on the carriage cooperate with a pair of recessed guide plates and an upstanding lug as affixed to any load to be transported. Once the carriage is fully engaged with any load, resilient pads are provided on the carriage to assure positive coupling engagement between the engaged load and the carriage. After transporting any coupled load, the load is also provided with a pair of sliding rods for initially engaging the base or support to which the load has been transported. Then, the pair of sliding rods also engage the pair of actuating rods so as to effect disengagement of the pawl from the lug thereby releasing the carriage with positive engagement from the transported load and permitting full disengagement of the carriage from the transported load. One of the advantages of the improved carriage is that it permits not only remote initial and positive engagement of any load to be transported but also remote disengagement of the carriage from any transported load. Moreover, positive coupling engagement between the carriage and the load assures positive transport of the load in suspended balanced fashion with minimal risks even though the load in being suspendingly transported is maneuvered; and thus subject to longitudinal, transverse and rotary movements or any combination thereof.

14 Claims, 6 Drawing Sheets

CARRIAGE FOR SELECTIVELY AND REMOTE POSITIVELY SUSPENDINGLY ENGAGING AND DISENGAGING A LOAD IN TRANSPORTING SAME FROM ONE LOCATION TO ANOTHER

IMPROVED MEANS

Improved carriage means for selectively engaging and disengaging a load in transporting same from one location to another; and, more particularly, it concerns an improved carriage means for selectively engaging a load to be suspendingly transported by use of a series of selectively arranged interactive means of particular unique design on both the load and carriage means by positively coupling the load to the carriage means once the load is fully engaged so that the load is transported in a stabilized manner despite any transverse, longitudinal or rotary movement during transport and then for selectively disengaging the carriage means from the transported load by use of these interactive means.

BACKGROUND OF THE INVENTION

Numerous designs have been developed over the years for transporting a load in some fashion from one location to another such as by engaging the load in some manner and then releasing the load once it is transported. For example, U.S. Pat. No. 1,834,499 to Richter concerns a man-operated overhead crane having an elevatable boom with a length substantially corresponding to the load being handled. Opposed ends of the boom are provided with power actuated pivotally mounted hooks for selectively engaging a workpiece to be hoisted and transported as required. U.S. Pat. No. 5,207,468 to Saunier et al discloses a hoistable sling for selectively engaging a transformer. The sling is made up of telescopically arranged sections for enabling adjustment to the size of the transformer load being handled. Opposed end portions of the sling and opposed portions of any transformer load are provided with cooperative hook and lever means for effecting selective engagement of any transport load for transport. However, none of the aforementioned references whether taken alone or in any combination remotely suggest the improved carriage means of the invention having among other things unique interengaging means on the load and carriage means generally comprised of: pivotally and biasingly mounted pawl means and upstanding apertured lug means; a pair of opposed guide block means, a pair of opposed channel-shaped recessed plate means; and opposed pair of actuating rod means biasingly mounted in the pair of guide block means. The rod means includes hingedly mounted bar means extending therebetween for releasably engaging the pawl means in an advanced postion so that the pawl means lockingly engages the lug means. All of these aforediscussed interengaging means cooperate to align and initially engage the carriage means relative to any load being transported until full engagement so that the carriage means is positively yet releasably coupled to the load for effecting suspended balanced transport of the load from one location to another and with minimal risks to person, property or the load itself despite any rotary, transverse or longitudinal movement of the suspended load about any axis. Once the transported load has reached its desired new location, the load in being supported by suitable base means causes actuation of an opposed pair of sliding rod means as appropriately mounted on the load for actuating the pair of biased actuating rod means on the carriage means so as to cause remote disengagement of the bar means from the pawl means in order to disengage the biased pawl means from the lug means thereby enabling remote and full disengagement of the carriage means from the load means in order that the carriage means can be readily reused for transporting another load.

SUMMARY OF THE INVENTION

An object of the invention is to provide an improved carriage means having a series of cooperative interengaging means on both the carriage means and the load for effecting selective remote engagement/disengagement with a load in being transported in suspendingly balanced fashion from one location to another despite any transverse, longitudinal or rotary maneuvering of the suspended load being transported.

Another object of the invention is to provide an improved lightweight carriage means that can be moved in any axial, rotary direction for selectively engaging/disengaging any load as the result of the series of interrelated, relatively spaced and interengaging hardware of various designs being provided on both the carriage means and any load whereby the load is positively yet releasably coupled to the carriage means thereby minimizing any hazard to people, property or the load itself in transporting any load from one location to another.

In summary, improved carriage means for selectively engaging/disengaging a load for transporting same in balanced suspended fashion from one location to another; where the engagement is a unique positive yet controllably releasable coupling between any load and the carriage means thereby permitting longitudinal, transverse and rotary movements or any combination thereof without endangering the load, property or any person involved. The carriage means is advantageously comprised of base means, post means and A-shaped plate means. The base means connects the carriage means to suitable boom means and the like for effecting desired maneuvering of the carriage means during use with or without a load. The post means securely interconnects the base means to the A-shaped plate means for the purpose of holding the A-shaped plate means in proper relationship to any load throughout the load being transported including any engagement/disengagement between any load and the carriage means. If desire, reinforcing strut means can be provided between the base means and the A-shaped plate means. Pivotally and biasingly mounted pawl means are provided on the carriage means between the post means and the A-shaped plate means, such that the pawl means is aligned with a slot in the A-shaped plate means for receiving an upstanding apertured lug means. The lug means is affixed to any load in centered relation to the load center of gravity for the purpose of minimizing imbalancing loads during suspended balanced transport of the load by the carriage means. A pair of laterally spaced and opposed guide block means are affixed to the A-shaped plate means in relation to the pawl means and are arranged to slidably and lockably engage opposed guide plate means affixed to any load. To this end, the pair of guide plate means, each have a pair of channel-shaped recesses for slidably receiving its associated guide block means. Accordingly, the opposed guide block means and plate means when they are in slidable engagement, the opposed block means not only engage opposed portions of the plate means within its recess but also overlappingly and abuttingly engage opposed portions of the load; thereby positively initially slidably engaging the load to the carriage means while positively restraining the load from any rotary movement relative to the engaged carriage means so that the pawl means and lug means (in being inserted in the A-shaped plate means slot during this carriage means and load engagement) are now arranged in alignment for engagement therewith. A pair of opposed actuating rod means are biasingly and slidably mounted in the opposed guide block means. At the same time, a bar extends between the opposed rod means and is hinged connected thereto. When the pawl means is in its biased retracted position against an opposed portion of the post means, an intermediate portion of the bar means is in abutting engagement with the upper end of the retracted pawl means.

With the carriage means in initial alignable engagement with the load to be transported, appropriate actuator means can engage the lower end of the pawl means for pivoting same against its bias. As the result of this pivoting action of the pawl means against its bias, the pawl means is advanced from a retracted position to an advanced position in engagement with apertured lug means inserted in the aligned A-shaped plate means slot thereby firmly securing the carriage means to the load. With the pawl means in its advanced position, an intermediate portion of the bar means because of the biasing action of the rod means is inserted between the upper end of the advanced pawl means and the post means such that the pawl means lower end positively and lockingly engages the lug means, thereby securing and positively coupling the engaged carriage means to the load to be transported. Moreover, the A-shaped plate means because of its A-shaped configuration provides a series of three apex ends for receiving a series of three resilient or elastomer-like pads. These pads serve to provide a positive, bindingly resilient, yet releasable coupling engagement between the load and carriage means despite any rotary, axial movement of the load in being suspendably and balancingly carried from one location to another with minimal risk to the load itself, people or property.

Once the load is transported, opposed slidably mounted rods on the load are actuated for actuating the opposed and biased rods as slidably mounted in the opposed guide blocks for advancing the rods against their bias thereby raising the rods and the bar means so as to release the bar from between the post means and the pawl means. Consequently, the pawl means is biasingly advanced from its advanced position to its retracted position thereby releasing the pawl means lower end from the lug means; and thus enabling the slidably engaged carriage means to be fully released from the transported load in remote fashion prior to the released carriage means being reused for engaging another load.

Other objects and advantages of the invention will become more apparent hereinafter when they are taken in conjunction with the appended specification, claims and drawings as hereinafter described.

DETAILED DESCRIPTION OF THE INVENTION

Figure 1:
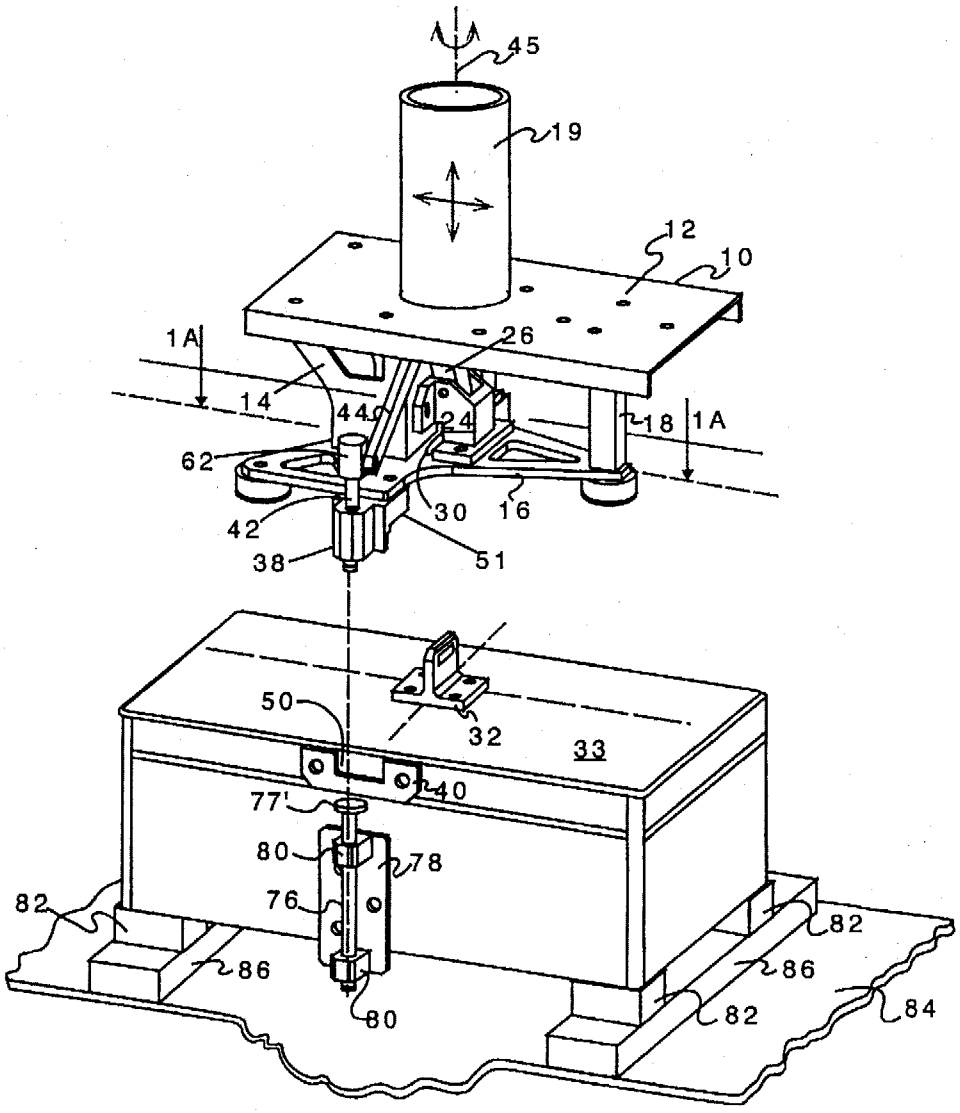
FIG. 1 is a perspective schematic view with parts broken away; and it illustrates a position of the improved carriage means as it progressively advances toward a load to be engaged and transported to another location.

With further reference to improved carriage means 10 as depicted in FIG. 1, it is generally comprised of channel-shaped base means 12, channel-shaped post means 14 of stub-like extent, A-shaped plate means 16 and reinforcing strut means 18. The base means is affixed in suitable fashion to boom means 19, such that the carriage means is fixedly secured to the boom means not only for support with or without any load 33 but also for effecting movement of the carriage means axial, rotary or any combination thereof. Post means 14 is apertured for minimizing weight while it is still of sufficient strength in being secured at its reduced lower end to the A-shaped plate means so as to positively retain the A-shaped plate means in parallel spaced relation to base means 12 throughout normal use of the carriage means. Depending on strength requirements for the one-piece integrated construction of the carriage means, rigidifying strut means 18 can be provided between base means 12 and the apex or convergent end of A-shaped plate means 16. As best shown in FIG. 2, reinforcing plate means 20 is provided for post means 14 in facilitating its securement to base means 12. Similarly, the upper end of strut means 18 includes a triangularly shaped plate means 22 for reinforcing the securement of strut means 18 to base means 12.

Figure 4:
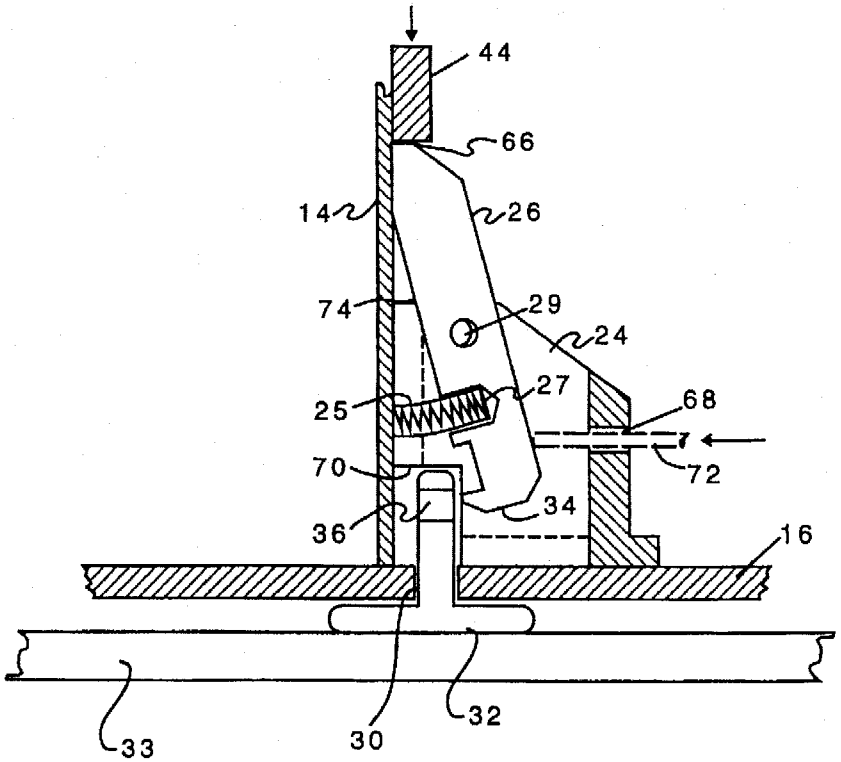
FIG. 4 is another enlarged sectional view as taken along line 4—4 of FIG. 2, with parts broken away and other parts added; and it illustrates further details of the interactive pawl and inverted V-shaped bar arrangement of the improved carriage means when the pawl is in a released and retracted biased position relative to the inverted V-shaped bar arrangement in its raised biased position prior to positive engagement of the initially engaged carriage means with a load to be transported.

As best illustrated in FIG. 2, channel-shaped bracket means 24 has opposed and angularly related flange means that facilitate aligned securement of the bracket means to both post means 14 and A-shaped plate means 16 such that pawl means 26 is biasingly and pivotally mounted in the channel-shaped recess of bracket means 24. With bracket means 24 being affixed by its upstanding pair of laterally spaced flange means to post means 14 and also being affixed by its other lower flange means to A-shaped plate means 16, biasingly pivotally mounted pawl means 26 in its retracted position at its upper end abuttingly engages post means 14. The upper end of pawl means 26 is relieved at its surface portion 28 to facilitate surface-to surface engagement of opposed portions of the pawl means and the post means as shown in FIG. 4.

Figure 1A:
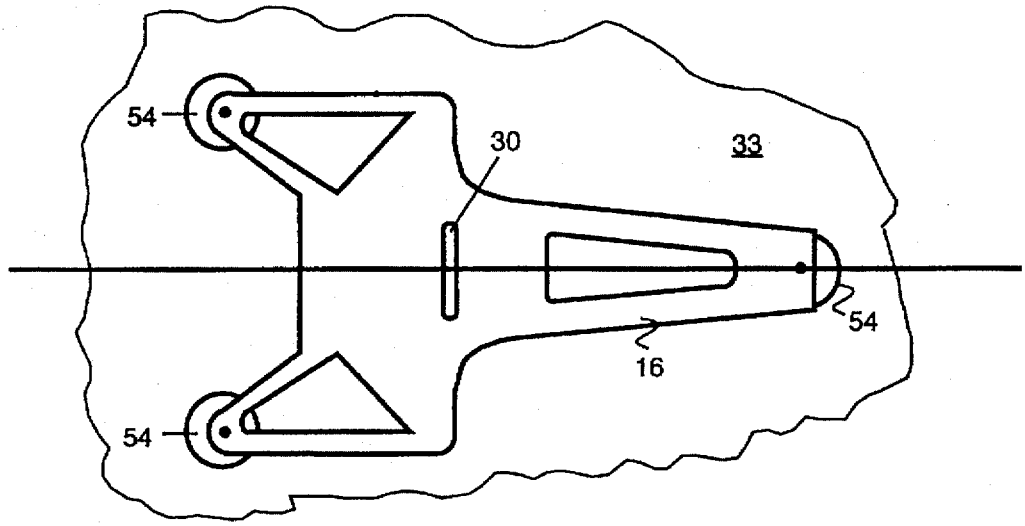
FIG. 1A is an enlarged plan view as taken along line 1A—1A of FIG. 1 with parts removed and other parts added; and it illustrates further details of the invention
Figure 5:
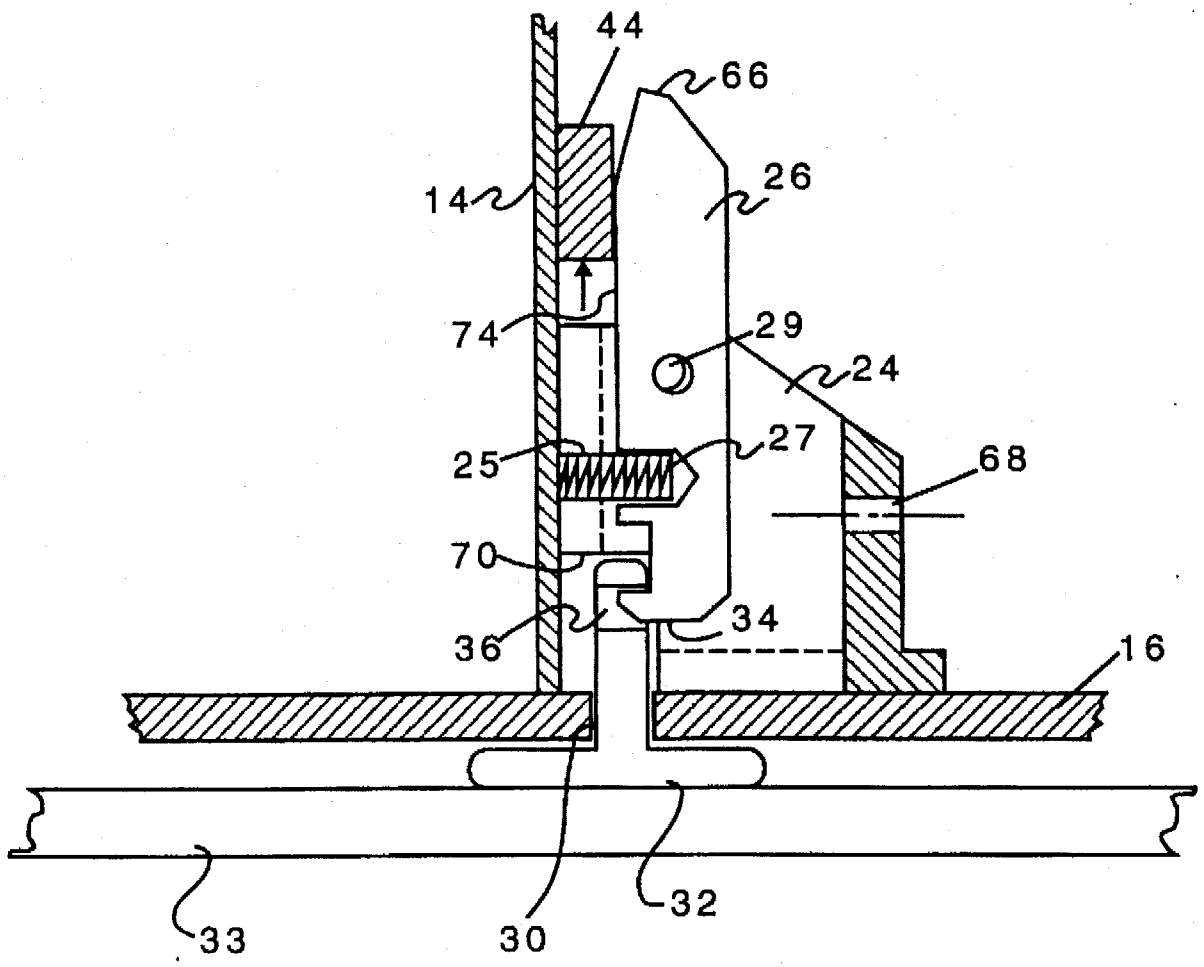
FIG. 5 is still another enlarged sectional view similar to FIG. 4; and it illustrates the pawl in a secured and advanced rotated position for positively and lockingly engaging lug means as affixed to a load.

As best depicted in FIG. 1A, elongated slot means 30 is provided and arranged transverse or crosswise of A-shaped plate means 16 between its ends for freely receiving upstanding lug means 32 when carriage means 10 is aligned and initially slidably engaged with any load 33 to be suspendingly transported in balanced fashion by the carriage means from one location to another. A-shaped plate means slot 30 is also arranged relative to affixed bracket means 24 and pawl means 26 such that lower hook-like end 34 of pawl means 26 is inserted in transverse slot means 36 of lug means 32 when pawl means 26 is advanced from its retracted biased position to its advanced position as best shown in FIGS. 4–5. Pawl means 26 are provided with biasing coil spring means 25 extending between post means 14 and spring-retaining hole means 27 of the pawl means. The hole means is interposed between lower end 34 of the pawl means and pawl means pivot shaft means 29 as best shown in FIG. 4. It is noted here and as best shown in FIG. 1, lug means 32 is affixed to any load in centered relation to the center of gravity such that load 33 is balanced when suspended by the carriage means, thereby minimizing adverse load reactions acting on the carriage means. Moreover, lug means 32 in being affixed to a trunk-like shaped load on the top surface thereof is also centered relative to the longitudinal and transverse axes thereof as depicted in FIG. 2. Although load 33 is of box-like shape, it is to be understood that carriage means 10 can engage and suspendingly transport any shaped load for transport so long as long as lug means 32 is affixed to an outer surface of any shaped load and in centered relation to the center of gravity thereof so as to minimize any reactive loads during handling of any load by the carriage means.

Figure 2A:
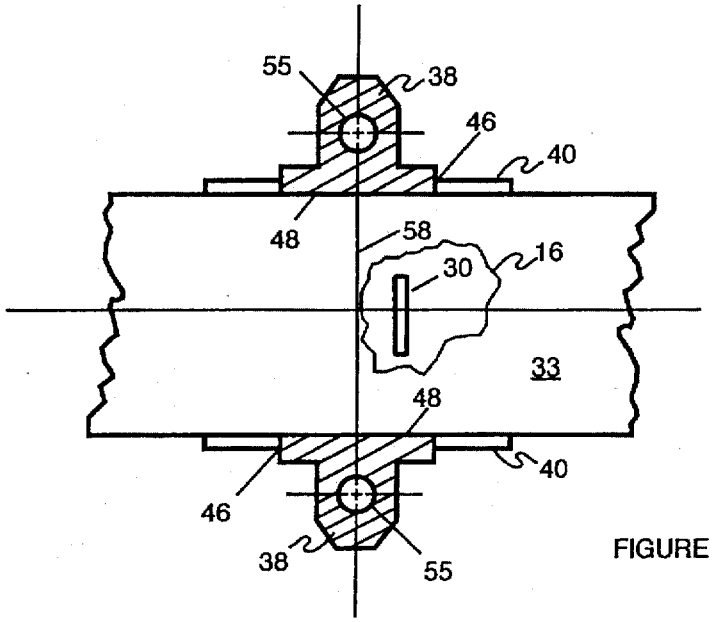
FIG. 2A is a sectional view taken along line 2A—2A of FIG. 2 with parts added; removed and other parts broken away; and it illustrates further details of the invention.
Figure 2:
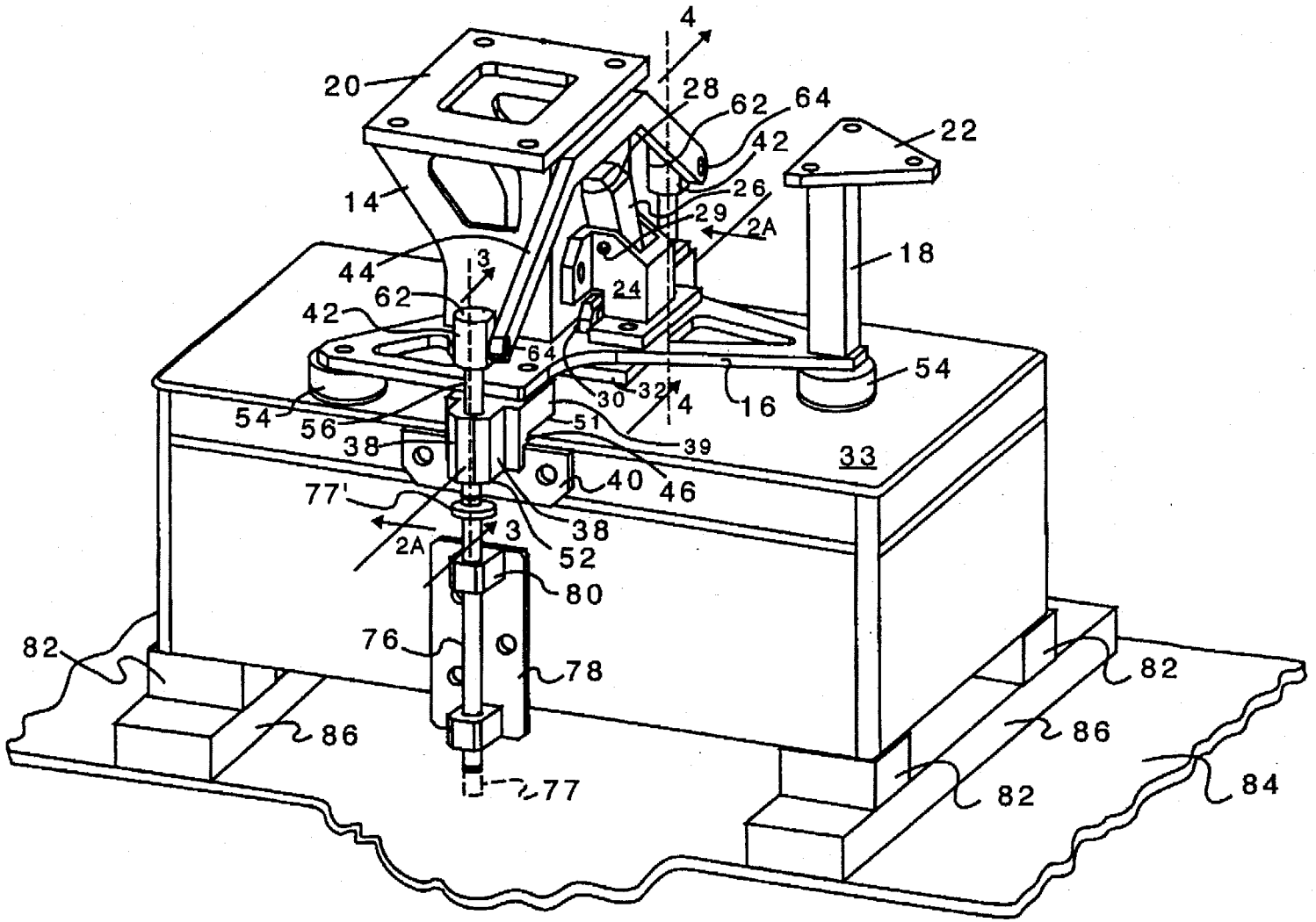
FIG. 2 is another perspective schematic view with parts added, and it illustrates initial engagement and alignment of the improved carriage means with a load to be transported to another location and prior to full and positive releasable locking engagement of the carriage means to the load.

A pair of laterally opposed and relatively spaced guide block means 38 are affixed in depending and transverse relation to A-shaped plate means 16, such that the guide block means are arranged in longitudinal offset relation to slot means 30 of A-shaped plate means 16 as best shown in FIG. 2A. This offsetness is such that there is no binding action between pawl means 26 and lug means 32, no binding action between the pair of guide block means 38 and the pair of recessed plate means 40 (as affixed to load 33) including opposed portions of load 33 associated therewith; and also no binding action between the pair of guide block means 38 and the pair of biased actuating sliding rod means 42 including their interconnecting bar means 44 which is arranged between pawl means 26 and post means 14 as best shown in FIG. 2.

Each guide block means 38 is of L-shaped configuration, such that its thinner section is affixed with its flat back face to the downwardly facing side of A-shaped plate means 16 as best illustrated in FIG. 2. Further each block means 38 in being affixed to A-shaped plate means is arranged at opposite corners (shoulder ends) of plate means 16 at intermediate the ends thereof, where its large A-shaped plate section necks down to the narrower convergent A-shaped plate section. The other and dependent block section of each affixed guide block means is provided with opposed side parallel planar faces 46 and interconnecting inwardly facing flat face 48 as depicted in FIG. 2A.

Each plate means 40 is affixed in opposed relation to opposed sides of load 33 such that opposed plate means 40 are aligned relative to lug means 32 so as to be in longitudinal offset relation to lug means 32 in a direction toward the left end of load 33 as viewed in FIG. 1. Each aligned and affixed plate means 40 is provided with a centered upwardly facing channel-shaped recess 50 as best shown in FIG. 1. Each recess 50 is laterally dimensioned so that opposed side edges of each plate means 40 defining recess 50 slidably engage opposed faces 46 of its associated guide block means 38. At the same time, opposed inwardly facing faces 48 of guide block means 38 slidably and overlappingly engage opposed portions of opposed sides of load 33 as depicted in FIG. 2A. Hence, when carriage means 10 is aligned with load 33 such that the pair of guide block means 38 are aligned with the pair of plate means 40, then these aligned block means and plate means slidably engage as carriage means 10 advances toward load 33; whereby the carriage means is initially engaged and aligned with load 33 for enabling positive yet controlled releasable coupling engagement between the load and carriage means.

Figure 6:
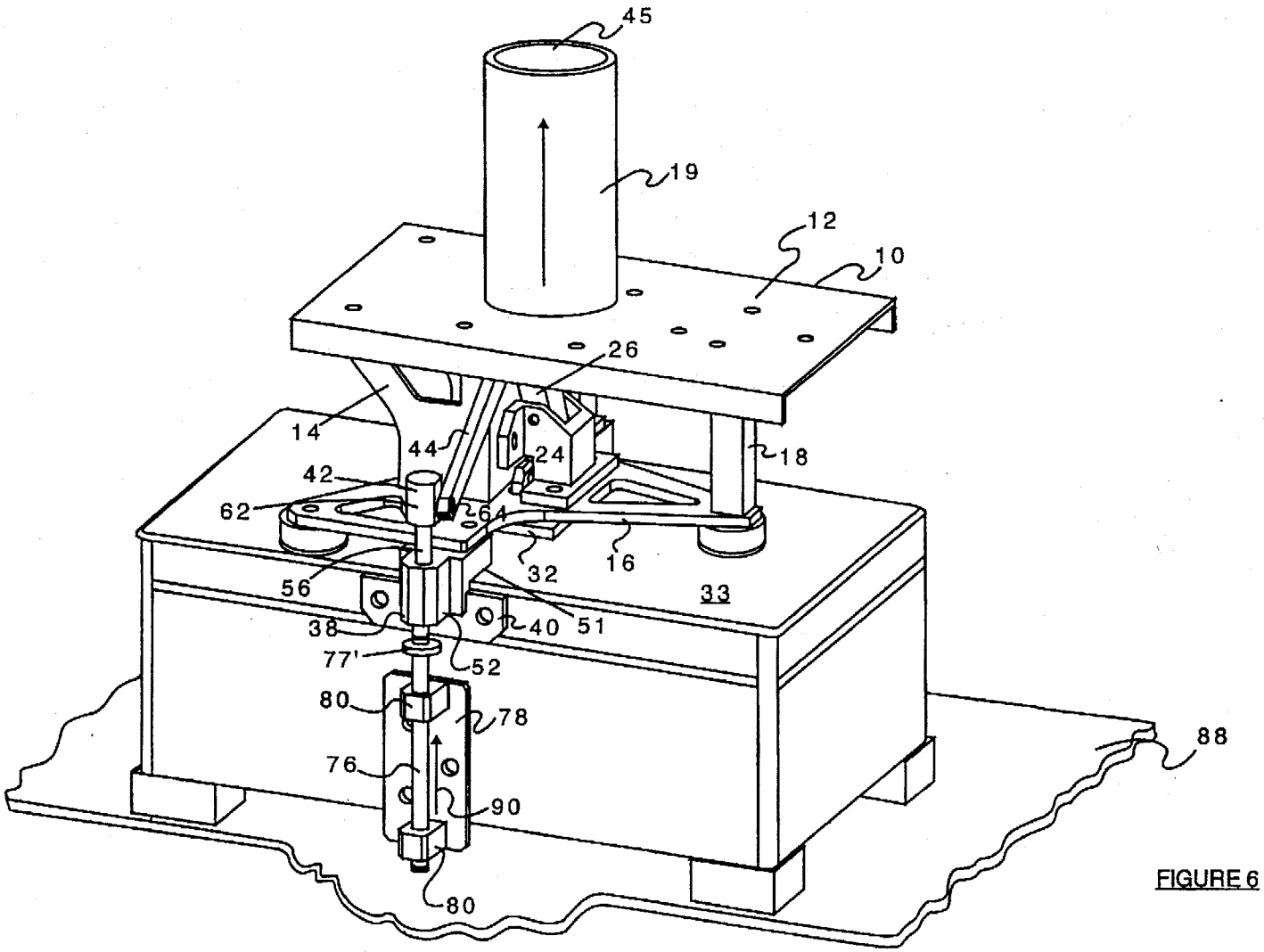
FIG. 6 is another perspective schematic view similar to FIG. 2; but with parts added, parts broken away and other parts removed; and it illustrates initial unlocking and partial disengagement of the carriage means from a load once the load has been transported by the improved carriage means to a desired location.

It is noted here and as illustrated in FIG. 6, that the depth of each channel-shaped recess 50 is such that lowermost face 52 of the depending section of each affixed block means 38 is spaced from the bottom of its associated channel-shaped recess 50 when load 33 and carriage means 10 are arranged in positive yet controlled releasable coupling engagement, thereby not interfering with such engagement. Because of the sliding engagement between opposed guide block means 38 and opposed plate means 40 affixed to opposed sides of load 33 and because of the overlapping sliding abutting engagement between opposed guide block means flat faces 46 and opposed side portions of load 33, the aligned carriage means in initial engagement with load 33 is positively constrained fom any movement about boom means axis 45 relative to load 33 thereby maintaining the aligned initial engagement between the carriage means and load 33 when pawl means 26 is in its retracted position as best shown in FIG. 2. It is further observed here that channel-shaped recess 50 of either plate means 40 is deep enough so that even if exposed major flat surface 51 of the inwardly extending section of either block means 38 impacts top portions of load 33 despite the series of three relatively spaced, resilient and elastomeric tire-like shaped pads 54 affixed to A-shaped plate means 16, that lower surface 52 of the depending section does not abut the bottom of the channel-shaped recess of its associated plate means 40, where such abutment might interfere with the positive coupling engagement between the carriage means and load 33 such as causing misalignment of plate means 16 relative to the load.

Figure 3:
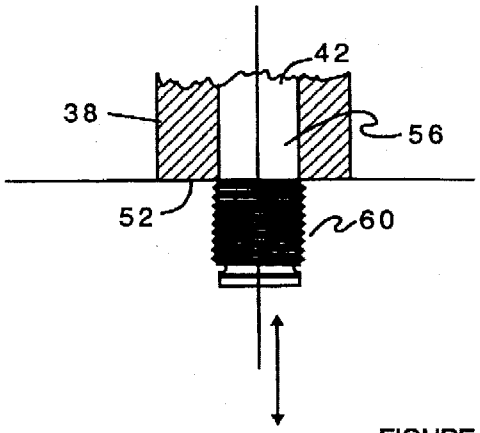
FIG. 3 is an enlarged sectional view as taken along line 3—3 of FIG. 2, with parts broken away and other parts added; and it also illustrates further details of the invention.

The opposed and aligned pair of guide block means 38 are provided with opposed and aligned downwardly extending longitudinal bores 55 for slidably receiving an opposed pair of biased actuating rods 42 at their reduced lower ends 56. The axes of opposed bores 55 at block 38 are centered so as to be aligned with and intersected by the transverse axis 58 of opposed blocks 38 thereby assuring that the pair of opposed rods 42 in being slidably arranged at their lower ends 56 in opposed bores 55 are maintained in proper relationship to post means 14 and pawl means 26 so as to preclude binding engagement between inverted V-shaped bar means 44 whether in its raised or lowered position (FIG. 4 or 5) as hereinafter further described. As best shown in FIG. 3, lower reduced end 56 of either rod means 42 is provided with coil spring means 60 such that the upper end of the spring means is suitably retained by surface 52 of associated block means 38 while the lower end of each spring means 60 is affixed in suitable fashion to the lowermost portion of lower end 56 of its associated rod means 42. Upper end 62 of either rod means 42 is enlarged and chordally faced off on one side for enabling pivotal interconnection of either outer end of bar means 44 to its associated rod means 42 as effected by suitable pin means 64 as best shown in FIG. 2. With continued reference to FIG. 2, when pawl means 26 is in its retracted position, a center portion of the intermediate section of bar means 44 is in abutting engagement with upper slightly relieved flat surface 66 of the pawl means (FIG.4). At this time, coil springs 60 are in a collapsed condition biasingly urging opposed rod means 42 from their raised position in 9 downward direction toward opposed guide block means 38 as best shown in FIG. 2.

With carriage means 10 in aligned and initial engagement with load 33, pawl means 26 can be advanced against its bias from its retracted position to its advanced position so that lower hook-like end 34 biasingly engages lug means 32 within its aperture 36. To this end as illustrated in FIG. 4, upstanding base portion of bracket means 24 is provided with a transverse opening 68, such that the opening is arranged between spring 25 and lower surface 70 of upper flange means to bracket means 24. At the same time, opening 68 is aligned with the lower end of pawl means 26. Actuator rod means 72 can be inserted through the opening into engagement with pawl means 26 and with continued movement of actuator rod means 72 in a direction towards pawl means 26, the pawl means is pivoted from its retracted position to its advanced position. It is noted here that actuator rod means 72 can be actuated in any suitable manner such as manually or by a suitable servo-motor (not shown). With the pawl means in its advanced position, pawl means lower end 34 engages lug means 32 in its aperture 36. At the same time bar means 44 because of the biasing action of opposed rod means 42 is lowered from a raised position to a lowered position so as to be interposed between opposed portions of post means 14 and pawl means 26 as best shown in FIG. 5. It is noted here that the shoulder between enlarged portion 62 of either rod means 42 and its reduced end 56 thereof limits the downward movement of the rod means to the upper end of its associated block means 38; and thus, the downward movement of bar means 44 is limited to the position shown in FIG. 5. Hence, when actuator rod 72 is removed from opening 68 after pawl means 26 is located in its advanced position with bar means 44 being interposed between pawl means 28 and post means 14 (FIG. 5) such that the pawl means is in locking engagement with the lug means, then engaged carriage means 10 and load 33 to be transported thereby are both in a positive yet controlled releasable coupled engagement, whereby the coupled load can be transported in suspendingly balanced fashion from one location to another with minimal danger to any person, property or load itself despite any longitudinal, transverse or rotary movements of the load and carriage means relative to and about any axis of boom means 19 as effected by any loom means movement.

When the carriage means and any load 33 are in positive coupled engagement, the series of three elastomeric pads 54 maintain planar, resilient engagement between carriage means 10 and load 33 despite maneuvering of the load in being transported from one location to another. Hence, as evident from FIGS. 2 and 5, the positive coupled engagement is maintained because of the resilient interaction between these series of three partially compressed pads 54 and opposed top surface portions of load 33 despite inertia effects of load 33 as it is being suspendingly balanced and supported by carriage means 10 in being transported from one location to another.

Opposed sliding rod means 76 are mounted on opposed sides of any load 33 relative to lug means as affixed to top surface means of the load so that the sliding rod means are arranged in longitudinal alignment with the lower ends of the pair of actuating rod means 42 and positioned therebeneath when carriage means 10 is arranged in alignment with the load prior to initial engagement. Each rod means 76 is slidably mounted by support bracket means 78 affixed to side portions of load 33 in opposed and aligned relation to each other in similar fashion as opposed guide block means 38 (FIG. 2A). Hence, the longitudinal axes of opposed rod means 76 are coincident with longitudinal axes of opposed rods 42; and thus, lie in a plane common with transverse axes 58 of opposed block means 38 (FIG. 2A) when carriage means 10 and load 33 are in engagement. To this end, each bracket means 78 has a pair of relatively spaced trunnions 80 for bearingly and slidably supporting each rod means 76.

Although not heretofore mentioned, when load 33 is to be engaged by carriage means 10 for transport, a series of four corner footings 82 of load 33 are raised above a base or floor support 84 by opposed spacer boards 86 as best illustrated in FIG. 2. As carriage means 10 advances into aligned and initial engagement with load 33, rod means 42 are in a raised position because pawl means 26 is in its retracted biased position (FIG. 4). At this time, upper enlarged flat ends of rods 76 may or may not engage the lowermost ends of rods 42. However, as shown in FIG. 2, the upper enlarged flat end of rod means 76 is in abutting engagement with the lower end of its associated reduced end 56 of rod means 42. After full initial engagement between carriage means 10 and load 33, a user of the carriage means can insert actuator rod 72 in bracket means opening 68 for advancing pawl means 26 from its retracted biased position to its advanced position (FIGS. 4–5). At this time, bar means 44 is advanced from its raised position to its lowered position by the biasing action of rod means 42 as sliding rod means 76 are advanced from their raised position to a lowered position as indicated by dotted lines at the lower end of rod means 76; and this lowered position being also generally indicated by reference numeral 77 having a dotted lead line as depicted in FIG. 2. By reason of opposed spacer blocks 86, rod means 76 in their lowered position (dotted lines) do not abut base 84; but they are spaced from base 84 so as not to interfere with the positive coupled engagement between the carriage means and the load.

Once the load is transported by the carriage means to its intended location and the four comer footings 82 of load 33 engage a base support 88, the downwardly extending rod means 76 are pushed upwardly from their lowered position against the downwardly biasing action of opposed rods 42 as indicated by solid arrow 90 in the manner illustrated in FIG. 6. The upward action of opposed rod means 76 causes bar means 44 to be advanced from its lowered position to its raised position, thereby causing pawl means 26 to be pivoted from its advanced position to its retracted biased position (FIGS. 5–6). With the pawl means in its retracted biased position, bar means 44 is now abutting top surface 66 of the pawl means; and thus, it is positively maintained in its raised position despite the biased downward action of opposed rod means 42. Hence, pawl means 26 is disengaged from lug means 32 and carriage means 10 is decoupled from positive engagement with transported load 33; thereby permitting full disengagement of the carriage means from the transported load. Once carriage means 10 is raised to a raised position by raising boom means 19 along its axis 45, the carriage means is fully separated from the transported load and ready to engage another load for transport as desired. Even if opposed rod means 76 slide to a lowered position while load 33 is being transported by the boom means and the carriage means, enlarged flat heads 77 at the upper ends of the opposed rod means 76 limit downward movement when these flat heads abuttingly engage upper trunnions 80 of brackets 78 as best depicted in FIG. 6. Accordingly, the improved carriage means in being of rigidified integrated construction is repeatedly reuseable for readily remotely engaging/disengaging any load to be transported in suspended balanced fashion in accordance with the invention.

Obviously many modifications and variations of the present invention are possible in light of the above teachings. It is therefore to be understood that within the scope of the appended claims and a reasonable interpretation thereof, the invention may be practiced otherwise than as specifically described above.

What is claimed is:

1. Improved carriage means for selectively engaging load means so as to positively couple same together for transporting the load means to a desired location and for selectively disengaging the carriage means from the load means once the load means has been transported by the carriage means a new location, the improved carriage means comprising:

selectively movable boom means, the boom means at its forward end having carriage means for selectively engaging and disengaging load means to be transported by both the boom means and carriage means from one location to another despite movement of the boom means in any direction about any longitudinal, transverse, rotary axes or any combination thereof, upstanding lug means affixed to surface means of the load means and in centered relation to the center of gravity thereof, the carriage means having A-shaped plate memos, the A-shaped plate means being affixed to the forward end of the carriage means such that the longitudinal axis of the A-shaped plate means is arranged in centered relation both longitudinally and transversely of the carriage means, the A-shaped plate means having slot means between the ends thereof such that the A-shaped plate means in being affixed to the carriage means the slot means is alignable with the upstanding lug means affixed to the load means and it is dimensioned for freely receiving the lug means when the carriage means engages the load means, and the carriage means having pivotally mounted pawl means rotatable in either direction about an axis, bracket means affixed to the A-shaped plate means for supporting the pivotally mounted pawl means such that the pawl means is rotatable in one direction against biasing action so as to be inserted through the aperture of the lug means and into engagement therewith when the lug means is inserted through the slot means of the A-shaped plate means upon the carriage means being advanced by the boom means into engagement with the load means for enabling suspended transport of the engaged load means from one location to another.

2. The improved carriage means as set forth in claim 1, wherein the pawl means includes biasing means for pivoting the pawl means in one direction about its axis for disengaging the pawl means from insertion in the aperture of the lug means and engagement therewith when the carriage means is being disengaged from the load means.

3. Improved carriage means as set forth in claim 1, wherein the A-shaped plate means is provided with a series of three relatively spaced resilient pad means, each of the resilient pad means being affixed to the exposed major surface of the A-shaped plate means and arranged at an apex end thereof such that the pad means simultaneously engage surface means of the load means at relatively spaced locations so as to maintain positive engagement of the rotated pawl means with the lug means as well as to enhance securement and rigidification of the engagement between the carriage means and the load means when the carriage means engages the load means for transporting same from one location to another.

4. Improved carriage means for selectively engaging load means so as to positively couple stone together for transporting the load means to a desired location and for selectively disengaging the carriage means from the load means once the load means has been transported by the carriage means to a new location, the improved carriage means comprising:

selectively movable boom means, the boom means at its forward end having carriage means for selectively engaging and disengaging load means to be transported by both the boom means and carriage means from one location to another despite movement of the boom means in any direction about any longitudinal, transverse, rotary axes or any combination thereof, upstanding lug means affixed to surface means of the load means and in centered relation to the center of gravity thereof, the carriage means having A-shaped plate means, the A-shaped plate means having convergent and divergent ends at opposed ends thereof and being affixed to the forward end of the carriage means such that the longitudinal axis of the A-shaped plate means is arranged in centered relation both longitudinally and transversely of the carriage means, the A-shaped plate means having slot means between the ends thereof such that the A-shaped plate means in being affixed to the carriage means the slot means is alignable with the upstanding lug means affixed to the load means and it is dimensioned for freely receiving the lug means when the carriage means engages the load means, the carriage means having a pair of relatively spaced guide block means, the pair of guide block means being affixed to a major exposed surface of the A-shaped plate means such that the pair of guide block means depend from the A-shaped plate means and are interposed between the divergent/convergent ends of the A-shape plate means and lie on a first axis transverse of the A-shaped plate means while at the same time the first axis of the pair of guide block means is laterally offset and spaced from the slot means, the carriage means also having pivotally mounted pawl means rotatable in either direction about an axis such that the pawl means is insertable through the aperture of the lug means upon the pawl means being rotated in one direction from a retracted biased position to an advanced position for insertion in the aperture of the lug means and engagement therewith when the lug means is inserted through the slot means of the A-shaped plate means, and a pair of guide plate means affixed to opposed surface means of the load means such that the upstanding lug means in being affixed to surface means of the load means is interposed and spaced from the pair of guide plate means, each of the pair of guide plate means having upwardly facing channel-shaped recess means for slidably receiving and engaging its associated guide block means of the pair thereof when the carriage means is advanced into engagement with the load means, each of the guide plate means in being affixed to its opposed surface means is alignable with a second axis transverse of the opposed surface means and extends therebetween while at the same time the second axis is laterally offset and spaced from the lug means in the same direction and in corresponding fashion as the first axis of the pair of guide block means is laterally offset and spaced from the slot means of the A-shaped plate means whereby the pair of guide block means initially and slidably engage the channel-shaped recess means of the opposed guide plate means for initially engaging and aligning the carriage means to the load means prior to the pawl means being pivoted from a retracted position to an advanced position through the aperture of the lug means into engagement therewith as the carriage means continues into engagement with the load means throughout advancement of both the boom means and the carriage means for positively coupling the carriage means and the load means together before transporting the load means in suspended balanced fashion to another location.

5. The improved carriage means as set forth in claim 4, wherein the pawl means includes biasing means for pivoting the pawl means in one direction about its axis from its advanced position to its retracted biased position for removing the pawl means from insertion in the aperture of the lug means and engagement therewith when the carriage means is being disengaged from the load means.

6. Improved carriage means as set forth in claim 4, wherein the A-shaped plate means is provided with a series of three relatively spaced resilient pad means, each of the resilient pad means being affixed to the exposed major surface of the A-shaped plate means at an apex end thereof such that the pair of guide block means are interposed between and spaced from the resilient pad means at the convergent apex end of the A-shaped plate means and the resilient pad means at the divergent apex ends thereof; and such that the pad means simultaneously engage surface means of the load means at relatively spaced locations so as to maintain positive engagement of the pawl means with the lug means as well as to maintain sliding engagement between the guide block means and the plate means as well as to enhance securement and rigidification of the engagement between the carriage means and the load means when the carriage means engages the load means for positively coupling them together before the boom means and carriage means transport the load means from one location to another despite any rotation and axial movement of the boom means and carriage means together about and along any axis thereof.

7. Improved carriage means for selectively engaging load means so as to positively couple same together for transporting the load means to a desired location and for selectively disengaging the carriage means from the load means once the load means has been transported by the carriage means to a new location, the improved carriage means comprising:

selectively movable boom means, the boom means at its forward end having carriage means for selectively engaging and disengaging load means to be transported by both the boom means and carriage means from one location to another despite movement of the boom means in any direction about any longitudinal, transverse, rotary axes or any combination thereof, upstanding lug means affixed to surface means of the load means and in centered relation to the center of gravity thereof, the carriage means having base means affixed to the outer end of the boom means, post means having opposed ends with one end affixed to the base means, A-shaped plate means having a convergent apex end and an opposed divergent end with opposed apex ends thereat, the divergent end of the A-shaped plate means being affixed to the other end of the post means and spaced from the base means, such that the longitudinal axis of the A-shaped plate means between its convergent/divergent ends is arranged in centered relation both longitudinally and transversely of the base means, the A-shaped plate means having slot means interposed between its convergent/divergent ends thereof, such that the A-shaped plate means in being affixed to the post means the slot means is laterally offset and spaced from the post means in a direction towards the convergent apex end thereof while it is alignable with the upstanding lug means affixed to the load means and it is dimensioned for freely receiving the lug means when the carriage means engages the load means, the carriage means having a pair of relatively spaced guide block means, the pair of guide block means being affixed to a major exposed surface of the A-shaped plate means such that the pair of guide block means depend from the A-shaped plate means and are interposed between the divergent/convergent ends of the A-shaped plate means and lie on a first axis transverse of the A-shaped plate means while at the same time the first axis of the pair of guide block means is laterally offset and spaced from the A-shaped plate means slot means in a direction towards the divergent end of the A-shaped plate means, the carriage means also having pivotally mounted pawl means rotatable in either direction about an axis such that the pawl means is insertable through the aperture of the lug means upon the pawl means being rotated in one direction from a retracted position to an advanced position for insertion in the aperture of the lug means and engagement therewith when the lug means is inserted through the slot of the A-shaped plate means upon engagement of the carriage means with the load means, and a pair of guide plate means affixed to opposed surface means of the load means such that the upstanding lug means in being affixed to surface means of the load means is interposed between and spaced from the pair of guide plate means, each guide plate means of the pair thereof having upwardly facing channel-shaped recess means for slidably receiving and engaging its associated guide block means of the pair thereof when the carriage means is advanced into engagement with the load means, each of the guide plate means in being affixed to its opposed surface means is alignable with a second axis transverse of the opposed surface means and extends therebetween while at the same time the second axis is laterally offset and spaced from the lug means in the same direction and in corresponding fashion as the first axis of the pair of guide block means is from the slot means of the A-shaped plate means whereby the pair of guide block means initially and slidably engage the channel-shaped recess means of the guide plate means for initially engaging and aligning the carriage means to the load means prior to the pawl means being pivoted from a retracted position to an advanced position through the aperture of the lug means into engagement therewith as the carriage means continues into engagement with the load means throughout advancement of both the boom means and the carriage means towards the load means for positively coupling the carriage means and the load means together before transporting the load means to another location.

8. The improved carriage means as set forth in claim 7, wherein the pawl means includes biasing means for pivoting the pawl means from its advanced position to its retracted biased position about its axis for disengaging the pawl means from insertion in the aperture of the lug means and engagement therewith when the carriage means is being disengaged from the load means.

9. Improved carriage means as set forth in claim 7, wherein the A-shaped plate means is provided with a series of three relatively spaced resilient pad means, each of the resilient pad means being affixed to the exposed major surface of the A-shaped plate means and arranged at an apex end thereof such that the pair of guide block means are interposed between and spaced from the resilient pad means at the convergent apex end of the A-shaped plate means and from the resilient pad means at the divergent apex ends thereof; and such that the pad means simultaneously engage surface means of the load means at relatively spaced locations so as to maintain positive engagement of the pawl means with the lug means as well as to enhance securement and rigidification of the engagement between the carriage means and the load means when the carriage means engages the load means for positively coupling them together before the boom means and carriage means transport the engaged load means in suspended balanced fashion from one location to another despite any rotation, longitudinal or transverse movement of the boom means and carriage means together about and along any axis thereof.

10. Improved carriage means as set forth in claim 7, wherein reinforcing means are interposed between and secured to the base means and the convergent apex end of the A-shaped plate means so as to further rigidify the carriage means including the A-shaped plate means thereof.

11. Improved carriage means as set forth in claim 7, wherein bracket means are interposed between and affixed to the post means and the A-shaped plate means in a direction toward the convergent apex end of the A-shaped plate means, the pawl means being inserted in the channel of the bracket means and pivotally mounted thereto such that the upper end of the pawl means abuts the post means when the pawl means is biasingly urged in one direction about its axis to its retracted position such that the lower end of the pawl means is pivoted to a position for nonengagement with the lug means when the lug means is inserted through the slot of the A-shaped plate means when the carriage means is in initial sliding engagement with the load means.

12. An improved carriage means as set forth in claim 11, wherein the lower end of the pawl means is provided with hook-like means for insertion through the aperture of the lug means and engagement therewith, wherein the bracket means includes hole means in alignment with the lower end of the pawl means, wherein the carriage means is comprised of actuator means selectively insertable through the hole means for engaging the lower end of the pawl means, the actuator means advancing the lower end of the pawl means from its retracted bias position to its advanced position for insertion of the hook-like means of the pawl means at its lower end in the aperture of the lug means for engaging same when the lug means is inserted through the slot means upon initial engagement between the carriage means and the load means thereby positively coupling the carriage means to the load means as the pair of guide block means are slidably engaged with the guide plate means within the channel-shaped recess means thereof.

13. Improved carriage means as set forth in claim 12, wherein the bar means is lowered from a raised position to a lowered position and being interposed between the post means and the pawl means as the result of the pawl means being advanced from its retracted biased position to its advanced position so as to hold the pawl means in its advanced position for engaging the lug means thereby having positive coupling engagement between the carriage means and the load means.

14. Improved carriage means as set forth in claim 13, wherein a pair of sliding rod means are mounted on opposed surface means of the load means such that the pair of sliding rod means are arranged in opposed and spaced relation to each other and such that the longitudinal axis of each sliding rod means is aligned with the longitudinal axis of the actuating rod means associated therewith of the pair thereof when opposed guide block means are aligned with their associated guide plate means and the channel shaped recess means thereof during engagement between the carriage means and the load means, and wherein the forward and lower ends of the pair of sliding rod means are arranged for engaging another base means to which the load means is transported so as to effect raised movement of the pair of actuating rod means against their biased lowered position thereby raising the bar means from a lowered position between the post means and the pawl means to a raised position above and in abutting engagement with the pawl means so as to effect retraction of the pawl means from an advanced position for engaging the lug means to a retracted biased position for disengagement from the lug means thereby releasing the carriage means from positive coupling engagement with the load means so as to permit disengagement of the carriage means from the load means after transporting the load means from one location to another.

* * * * *